US006946437B2

(12) United States Patent
Aizawa et al.

(10) Patent No.: US 6,946,437 B2
(45) Date of Patent: Sep. 20, 2005

(54) PROCESS FOR REMOVING SOLVENT FROM ANIONIC SURFACTANT, AND ANIONIC SURFACTANT POWDER PRODUCED THEREBY

(75) Inventors: Kazunori Aizawa, Wakayama (JP); Kazuhito Miyoshi, Wakayama (JP); Osamu Tabata, Wakayama (JP)

(73) Assignee: KAO Corporation, Tokyo (JP)

( * ) Notice: Subject to any disclaimer, the term of this patent is extended or adjusted under 35 U.S.C. 154(b) by 0 days.

(21) Appl. No.: 09/983,269

(22) Filed: Oct. 23, 2001

(65) Prior Publication Data

US 2002/0107167 A1 Aug. 8, 2002

(30) Foreign Application Priority Data

Oct. 23, 2000 (JP) ..... 2000-322125

(51) Int. Cl.[7] ..... C11D 17/00

(52) U.S. Cl. ..... 510/446; 510/424; 510/426; 204/159; 204/157.43; 34/259; 159/DIG. 126

(58) Field of Search ..... 510/446, 447, 510/349, 351, 352, 356, 441, 424, 426; 204/157.43, 159; 34/259; 159/DIG. 126

(56) References Cited

U.S. PATENT DOCUMENTS

| | | | |
|---|---|---|---|
| 4,118,333 | A | 10/1978 | Dugan et al. |
| 4,715,979 | A | 12/1987 | Moore et al. |
| 5,538,671 | A | 7/1996 | Morrall |
| 5,866,531 | A | 2/1999 | Assmann et al. |
| 5,961,663 | A | 10/1999 | Schramm, Jr. |
| 6,063,751 | A | 5/2000 | France et al. |

FOREIGN PATENT DOCUMENTS

| | | | |
|---|---|---|---|
| BE | 1004876 | A5 | 2/1993 |
| DE | 43 23 527 | A1 | 1/1995 |
| DE | 4404633 | | 8/1995 |
| JP | 62-169898 | A | 7/1987 |
| JP | 62-169900 | A | 7/1987 |
| JP | 8-502785 | A | 3/1996 |
| JP | 10504349 | | 4/1998 |

OTHER PUBLICATIONS

Mitsufuji Muneo, "Refrigerator Oil Composition", Dialog abstract of JP 62–16898 (Jul. 27, 1987).

*Primary Examiner*—Necholus Ogden
(74) *Attorney, Agent, or Firm*—Birch, Stewart, Kolasch & Birch, LLP

(57) ABSTRACT

An anionic surfactant powder prepared by subjecting a mixture of an anionic surfactant and a solvent to microwave irradiation to remove at least a part of the solvent, and a process for preparing the anionic surfactant. The anionic surfactant powder can be suitably used for laundry detergents, detergents for tableware and kitchenware, foaming agents for toothpastes, powdery shampoos, emulsifying agents for polymerization, foaming agents for cement plaster and the like.

6 Claims, 2 Drawing Sheets

PROCESS FOR REMOVING SOLVENT FROM ANIONIC SURFACTANT, AND ANIONIC SURFACTANT POWDER PRODUCED THEREBY

BACKGROUND OF THE INVENTION

1. Field of the Invention

The present invention relates to an anionic surfactant powder. More specifically, the present invention relates to an anionic surfactant powder which can be suitably used for, for instance, laundry detergents, detergents for tableware and kitchenware, foaming agents for toothpastes, powdery shampoos, emulsifying agents for polymerization, foaming agents for cement plaster and the like, and a process for preparing the anionic surfactant powder.

2. Discussion of the Related Art

An anionic surfactant powder has been used for foaming agents for toothpastes, powdery shampoos and cleaning agents as well as laundry detergents and detergents for tableware and kitchenware by mixing the powder with other surfactant or a builder.

As a process for preparing a powder or granule of an anionic surfactant, there have been known (A) a process comprising spray-drying a low-concentration slurry having a water content of 60 to 70% by weight with taking its viscosity into consideration as disclosed in Japanese Patent Laid-Open No. Sho 55-69698 and Sho 53-39307; (B) a process comprising spray-drying a high-concentration slurry having a solid content of 60 to 80% by weight by utilizing a minimal value of viscosity of the slurry of an alkyl sulfate as disclosed in Japanese Patent Laid-Open No. Sho 54-106428; and (C) a process comprising drying a raw material for a high-concentration detergent paste having a water content of 20 to 35% by weight as disclosed in Japanese Patent Laid-Open No. Hei 2-222498; and the like.

However, there are some defects in the above process (A) such that the process necessitates a large-scale drying apparatus and high drying energy since this process comprises a spray-drying process.

Also, there are some defects in the above process (B) such that the process necessitates a large-scale drying apparatus while the process does not necessitate high energy, and impurities such as an unreacted alcohol remaining in the sulfation reaction would be incorporated into a product since the process uses a high-concentration slurry.

In addition, according to the above process (C), a problem concerning powdering of the anionic surfactant itself has not yet been sufficiently solved, nevertheless there is used a continuous drying process of a raw material of a paste used for a high-density detergent using a vacuum thin film dryer.

Therefore, in view of these processes, Japanese Patent Laid-Open No. Hei 5-331496 discloses a process for preparing an anionic surfactant powder having a low impurity concentration, with a small drying load and a small-scale drying apparatus.

There are some advantages in the process as described in the above-mentioned publication such that the drying load is small, that the powder has little thermal deterioration and is excellent in hue since drying is carried out at low temperatures in a short time period, and that an unreacted alcohol can be reduced by feeding an inert gas during drying.

In the above process, an external heating system is employed, and thermal energy is fed to an object for drying by using heat conductivity, convection or radiation.

Therefore, heat is translated from the surface of the object to its internal. Accordingly, when the surface temperature of the object is controlled to suppress quality deterioration, a longer time period is required for drying, and the surface area for translating heat should be enlarged. In addition, when the surface temperature is increased, there is a possibility that the quality of the drying object would be deteriorated by its localized heating.

Also, the development of a process for reducing the amount of impurities such as an unreacted alcohol and dioxane has been desired from the viewpoint of quality.

An object of the present invention is to provide an anionic surfactant powder having a small content of impurities such as an unreacted alcohol.

Another object of the present invention is to provide a process for preparing the anionic surfactant powder with a low energy load, which can efficiently dry a solvent mixture containing the anionic surfactant in a short time period without any quality deterioration.

These and other objects of the present invention will be apparent from the following description.

SUMMARY OF THE INVENTION

According to the present invention, there are provided:

(1) an anionic surfactant powder prepared by subjecting a mixture of an anionic surfactant and a solvent to microwave irradiation to remove at least a part of the solvent from the mixture;

(2) a process for preparing anionic surfactant powder comprising subjecting a mixture of an anionic surfactant and a solvent to microwave irradiation to remove at least a part of the solvent; and (3) a process for preparing anionic surfactant powder comprising defoaming a mixture of an anionic surfactant and a solvent, and subjecting the mixture to microwave irradiation to remove at least a part of the solvent from the mixture.

DETAILED DESCRIPTION OF THE INVENTION

Figure 1:
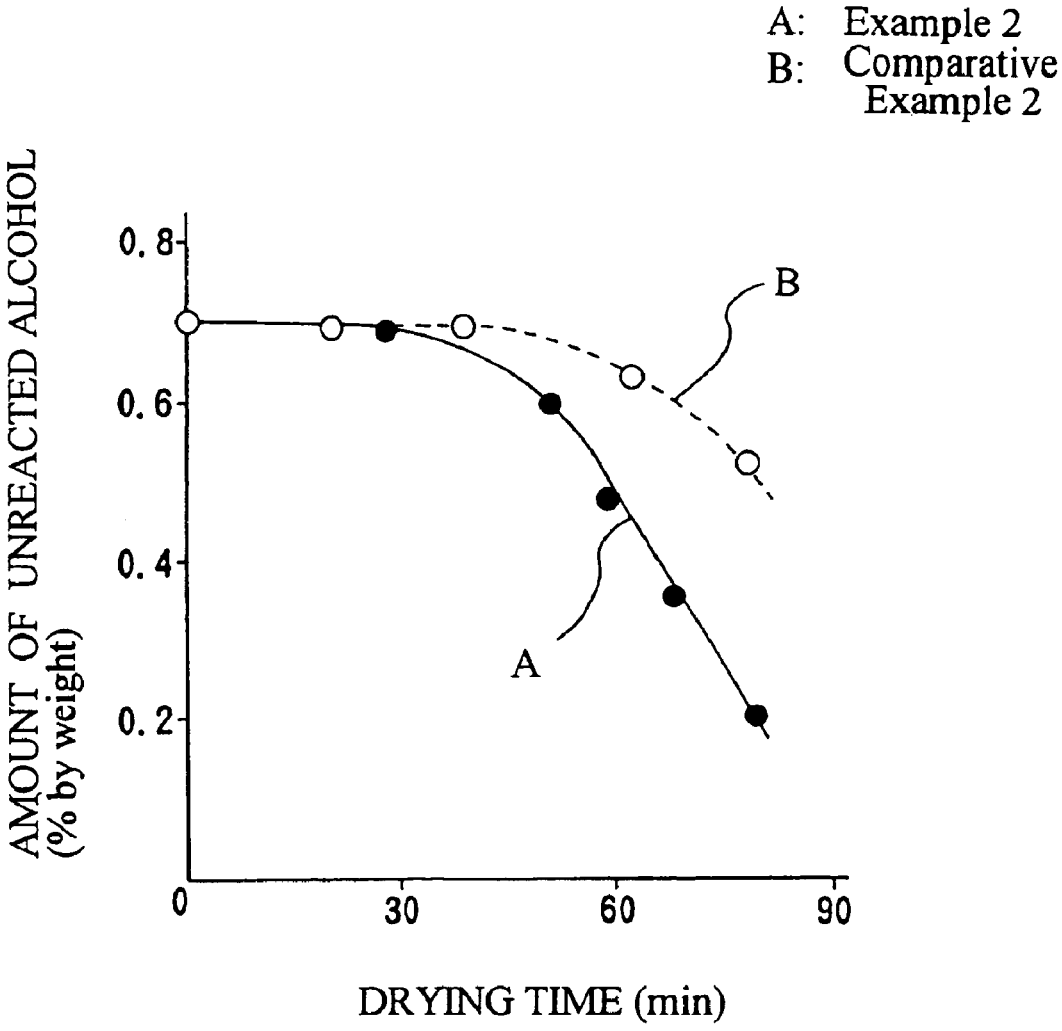
FIG. 1 is a graph showing amounts of an unreacted alcohol with the passage of time in Example 2 and Comparative Example 2.

The anionic surfactant is not limited to specified ones. Examples of the anionic surfactant include alkyl sulfates, polyoxyethylene alkyl ether sulfates, alkylbenzenesulfonates, salts of α-sulfofatty acid esters, and the like. Among them, the alkyl sulfates and the polyoxyethylene alkyl ether sulfates are preferable. The salts include alkali metal salts, alkaline earth metal salts, ammonium salts, alkanolamine salts, and the like. Among those salts, the alkali metal salts are preferable, and sodium salts, potassium salts and mixtures thereof these salts are more preferable.

The alkyl sulfate and the polyoxyethylene alkyl ether sulfate are obtained by, for instance, sulfating an alcohol, or an adduct obtained by adding an alkylene oxide compound such as ethylene oxide or propylene oxide to a higher alcohol; and neutralizing the sulfated product. During the sulfation reaction, an unreacted substance may exist within the range of not more than 10% by weight, preferably not more than 5% by weight in the reaction system.

Examples of the alkyl sulfate include an alkyl sulfate represented by the formula (I):

$$(R^1—OSO_3)_mM^1 \quad (I)$$

wherein $R^1$ is a linear or branched alkyl group or alkenyl group having 8 to 24 carbon atoms, preferably 8 to 18 carbon atoms; $M^1$ is an alkali metal atom, an alkaline earth metal atom, or an alkanol-substituted or alkanol-unsubstituted ammonium group; m means a valence of $M^1$, such as 1 or 2; and the like.

In addition, examples of the polyoxyethylene alkyl ether sulfate include a polyoxyethylene alkyl ether sulfate represented by the formula (II):

$$(R^2O—(AO)_nSO_3)_pM^2 \quad (II)$$

wherein $R^2$ is a linear or branched alkyl group or alkenyl group having 8 to 24 carbon atoms, preferably 8 to 18 carbon atoms; A is an alkylene group having 2 to 4 carbon atoms, wherein each of A may be the same or different; n means an average molar number of an alkylene oxide added, such as 0.5 to 20; $M^2$ is an alkali metal atom, an alkaline earth metal atom, or an alkanol-substituted or alkanol-unsubstituted ammonium group; p means a valence of $M^2$, such as 1 or 2; and the like.

In the formula (II), AO includes ethylene oxide, propylene oxide, butylene oxide, and the like. It is preferable that the average molar number of the AO added is 1 to 10.

The mixture may be those prepared by dissolving a part or all of the anionic surfactant in a solvent, and the mixture may be in the form of a slurry, or a solid having no fluidity.

The solvent includes water, a polar organic solvent such as a lower alcohol (methanol, ethanol and isopropanol) or a ketone, and mixtures thereof. Among them, a solvent with water is preferable, and water is especially preferable.

An objective anionic surfactant powder in the present invention is a so-called "dry state" from which solvents are sufficiently removed. More specifically, the content of the solvent in the mixture is preferably not more than 5% by weight, more preferably not more than 1% by weight.

The concentration of the anionic surfactant (solid content, hereinafter referred to the same) in the mixture is not limited to specified ones. It is preferable that the concentration of the anionic surfactant is higher than 0% by weight and less than 95% by weight. The concentration of the anionic surfactant is more preferably 60 to 95% by weight, in consideration of working efficiency and energy load. The concentration of the anionic surfactant is still more preferably 85 to 95% by weight, from the viewpoint of even further reducing the energy load.

On the other hand, the content of the solvent in the mixture is not limited to specified ones. The content of the solvent in the mixture is preferably not more than 40% by weight, more preferably not more than 25% by weight, still more preferably not more than 15% by weight, from the viewpoint of reducing the amount of impurities. The content of the solvent means a value where microwave irradiation has been carrying out. Therefore, the amount of the solvent does not mean a value at the initial stage of microwave irradiation.

Therefore, microwave irradiation can be started, for instance, at the initial stage of drying where the content of the solvent is not less than 25% by weight. Alternatively, microwave irradiation can be started at the stage where the content of the solvent attains to not more than 25% by weight during drying. In this case, when the mixture is dried so that the content of the solvent becomes not more than 5% by weight, preferably not more than 1% by weight, there can be obtained a high-quality anionic surfactant powder having a very small content of impurities such as an unreacted alcohol (for instance, in a case where the anionic surfactant is an alkyl sulfate).

A process for controlling the concentration of the anionic surfactant in the mixture to 60 to 95% by weight includes, for instance, a process comprising pre-concentrating a mixture having a concentration of the anionic surfactant of less than 60% by weight; a process comprising directly obtaining a high-concentration slurry in a neutralization step by utilizing a minimal value of its viscosity; and the like. The present invention is not limited only to those processes.

In addition, besides the anionic surfactants, other additives can be added to the mixture as occasion demands.

Other additives include, for instance, alkalizing agents such as silicates, carbonates and sesquicarbonates such as sodium sesquicarbonate, potassium sesquicarbonate and magnesium sesquicarbonate; divalent metal ion capturing agents such as citrates and zeolite; re-deposition preventives such as polyvinyl pyrrolidone and carboxymethyl cellulose; caking preventives; antioxidants; and the like. Those additives can be used within the range which would not hinder the object of the present invention.

In addition, an inorganic salt may be contained in the mixture.

Representative examples of the inorganic salt include, for instance, sodium chloride, sodium sulfate, and the like. The inorganic salt can be added to the mixture as they are. Alternatively, the inorganic salt can be generated in the mixture by a reaction. For instance, when NaClO (sodium hypochlorite) is added to the mixture for the purpose of improving the hue of a dry raw material, NaCl (sodium chloride) can be generated in the mixture. When the, process of adding sodium hypochlorite to the mixture is employed, sodium chloride is produced as an inorganic salt, and decoloration can be carried out. Therefore, the process is preferable in the present invention.

The amount of the inorganic salt is not limited to specified ones, as long as it is within the range which would not hinder the object of the present invention. It is desired that the amount of the inorganic salt is usually not more than 10 parts by weight, preferably not more than 2 parts by weight, based on 100 parts by weight of the anionic surfactant, from the viewpoint of maintaining the high solid content of the anionic surfactant.

In the present invention, a dryer having a given volume can be charged with a defoamed mixture obtained by defoaming the mixture under reduced pressure with a defoaming device such as a deaerator. When the defoaming device is used, there are some advantages such that the mixture can be efficiently treated without its volume expansion under reduced pressure since bubbles contained in the mixture are reduced.

When defoaming is carried out under reduced pressure using a usual deaerator, evaporation of solvent vapor occurred during defoaming, so that the temperature drop of the mixture is caused. Therefore, the viscosity of the mixture increases, so that the fluidity may be lowered. Accordingly, in order to carry out the continuous defoaming stably, it is preferable to defoam the mixture only with a flat plate of the deaerator formed by removing the screen set from the deaerator. When the defoaming is carried out only with a flat plate of the deaerator, there are some advantages that the defoaming can be stably and continuously carried out, and that the reduction of the solvent content of the mixture can be accelerated, so that the drying time can be shortened.

According to the present invention, when the solvent is removed from the mixture, heating by applying microwave is employed. Therefore, the microwave directly acts as an electromagnetic wave on a dielectric contained in the mixture to be dried, so that polar molecules rotate and heat is generated by the friction and collision of the polar molecules, resulting in the heating (simultaneous heating of its surface and internal part). Therefore, quality deterioration of the resulting anionic surfactant powder can be suppressed.

In addition, since the mixture is also uniformly heated from its internal portion, the solvent is also distilled from the internal portion, thereby making the resulting mixture porous, to give a powder which is excellent in solubility.

Also, when the amount of the dielectric (solvent) is reduced in the mixture, the microwaves also act on the impurities (an unreacted alcohol in a case of an alkyl sulfate) contained in the mixture, in addition to the formation of pores in the mixture. Therefore, the impurities as well as the solvent can be easily distilled from the internal portion of the mixture. Accordingly, it is presumed that excellent effects such that the impurities are easily removed from the mixture are exhibited.

In the present invention, the mixture is introduced into a dryer equipped with a microwave generator, and thereafter the microwave is generated from the microwave generator.

Since water is especially preferable among the polar solvents, the present invention will be described hereinbelow by taking water as an example.

When water is heated with microwaves, the calorific value of water is proportional to the frequency of microwaves. It is preferable that the frequency of the microwaves is higher. However, when the frequency of the microwave is too high, the dielectric constant of water is lowered, so that the calorific value of water tends to be lowered. Therefore, in consideration of these matters, it is desired that the frequency of the microwave generated from the microwave generator of the dryer is 300 to 30000 MHz, preferably 300 to 10000 MHz.

The temperature of the mixture during drying is not limited to specified ones, as long as the temperature of the mixture is not lower than room temperature. It is preferable to determine the upper limit of the drying temperature of the mixture in accordance with the kinds of the compounds contained in the mixture, from the viewpoint of preventing degradation or deterioration of the anionic surfactant. For instance, when an alkyl sulfate is used as an anionic surfactant, it is desired that the temperature of the mixture during drying is not higher than 150° C., preferably not higher than 120° C.

In addition, it is preferable that the microwave irradiation is carried out under reduced pressure. Concretely, the lower the pressure inside the dryer is, the more easy drying can be carried out at low temperatures. However, when the pressure is too low, electric discharge is caused in the dryer, so that the energy of the microwave is wasted. Therefore, it is desired that the pressure during the microwave irradiation is 4 to 100 kPa, preferably 4 to 55 kPa, more preferably 6 to 30 kPa.

Thus, the mixture is subjected to microwave irradiation, thereby giving an anionic surfactant powder in which at least a part of the solvent is removed.

The phrase "at least a part of the solvent is removed" as referred to herein means that all or a part of the solvent contained in the mixture is removed. The amount of the solvent to be removed cannot be absolutely determined because the amount of the solvent to be removed differs depending upon the content of the solvent in the mixture at the initial stage of the microwave irradiation. The amount of the solvent to be removed is usually an amount which gives final desired powder.

In the present invention, in addition to the dryer attached to the microwave generator, a conventional dryer having an external heating system can be used together with the dryer attached to the microwave generator. When a dryer having an external heating system is used together with the microwave generator, the drying time period can be shortened. For instance, during drying, the quality deterioration of the anionic surfactant powder can be suppressed by using the conventional dryer having an external heating system for a constant-rate period of drying (a period of time in which the solvent sufficiently exists, and the temperature of the mixture is does not exceed the equilibrium temperature at which the temperature of the mixture depends upon the pressure inside the system), and subsequently heating the mixture with microwaves for a decreasing-rate period of drying (a period of time in which the amount of the solvent is reduced, and the temperature of the mixture is higher than the equilibrium temperature of the mixture), resulting in the prevention of the quality deterioration of the anionic surfactant powder and shortening of the drying time.

As the dryer having an external heating system, there can be used a generally employed dryer in a continuous process or batch process.

The dryer in the continuous process includes, for instance, rotary thin film evaporators such as CONTRO and SEBCOM (hereinabove commercially available from Hitachi, Ltd., trade names); a belt-type continuous vacuum evaporator such as BELLMAX (commercially available from OKAWARA MFG. Co., LTD., trade name); and the like.

The dryer in the batch process includes, for instance, a mixer vacuum dryer; MICROWAVE GRANULATOR DRYERS commercially available from Fukae Powtec Corporation; MIXER DRYER commercially available from Tanabe-WILLTEC INC.; and the like.

In addition to the pressure control by the dryer, the amount of impurities such as an unreacted alcohol contained in the mixture can be further reduced by blowing a gas such as air, an inert gas or water vapor into the mixture inside the dryer during the powdering. In other words, when the gas such as air, an inert gas or water vapor is introduced into the mixture inside the dryer, the evaporation of the unreacted alcohol and the by-products contained in the mixture are accelerated by the partial pressure drops of the unreacted alcohol and the by-products, whereby those amounts can be reduced. The inert gas may be any of those which are unreactive with the anionic surfactant. The inert gas includes, for instance, helium, nitrogen, argon, carbon dioxide gas, and the like. Among them, nitrogen and carbon dioxide gas are preferable.

The amount of the gas such as air, an inert gas or water vapor blown into the mixture inside the dryer cannot be absolutely determined because the amount of the gas differs depending upon the amount of the mixture charged. It is preferable that the amount of the gas is 1 to 100 parts by weight or so, based on 100 parts by weight of the mixture, from the viewpoints of effectively removing impurities and increasing the productivity.

EXAMPLES

Examples 1 and 2

65-liter MICROWAVE GRANULATOR DRYER commercially available from Fukae Powtec Corporation, under the trade name of FMD-65JE was charged with 20 kg of an anionic surfactant slurry containing an alkyl sulfate having 10 to 16 carbon atoms and an average molecular weight of 300 as an anionic surfactant, and having a concentration of 72.5% by weight [amount of unreacted alcohol: 0.7 parts by weight based on 100 parts by weight of the anionic surfactant; water content in the anionic surfactant slurry: 26.7% by weight; pH (10% by weight aqueous solution): 10.9]. The anionic surfactant slurry was powdered by subjecting the slurry to microwave irradiation under the conditions of a jacket temperature of 90° C., a pressure of 13 kPa, an agitator rotational speed of 200 r/min, a chopper rotational speed of 500 r/min, a microwave frequency of 2450 MHz and an output of 2 kW, with varying the drying time as shown in Table 1, to give an anionic surfactant powder.

Comparative Examples 1 and 2

The same powdering procedures as in Example 1 were carried out except for omitting the microwave irradiation and changing the drying time as shown in Table 1, to give an anionic surfactant powder.

Experiment

Each of the powders obtained in Example 1 and Comparative Example 1 was sieved, to give a powder having a particle diameter of not less than 500 μm and less than 1410 μm, and the solution rate of the powder was determined by the following method.

Figure 2:
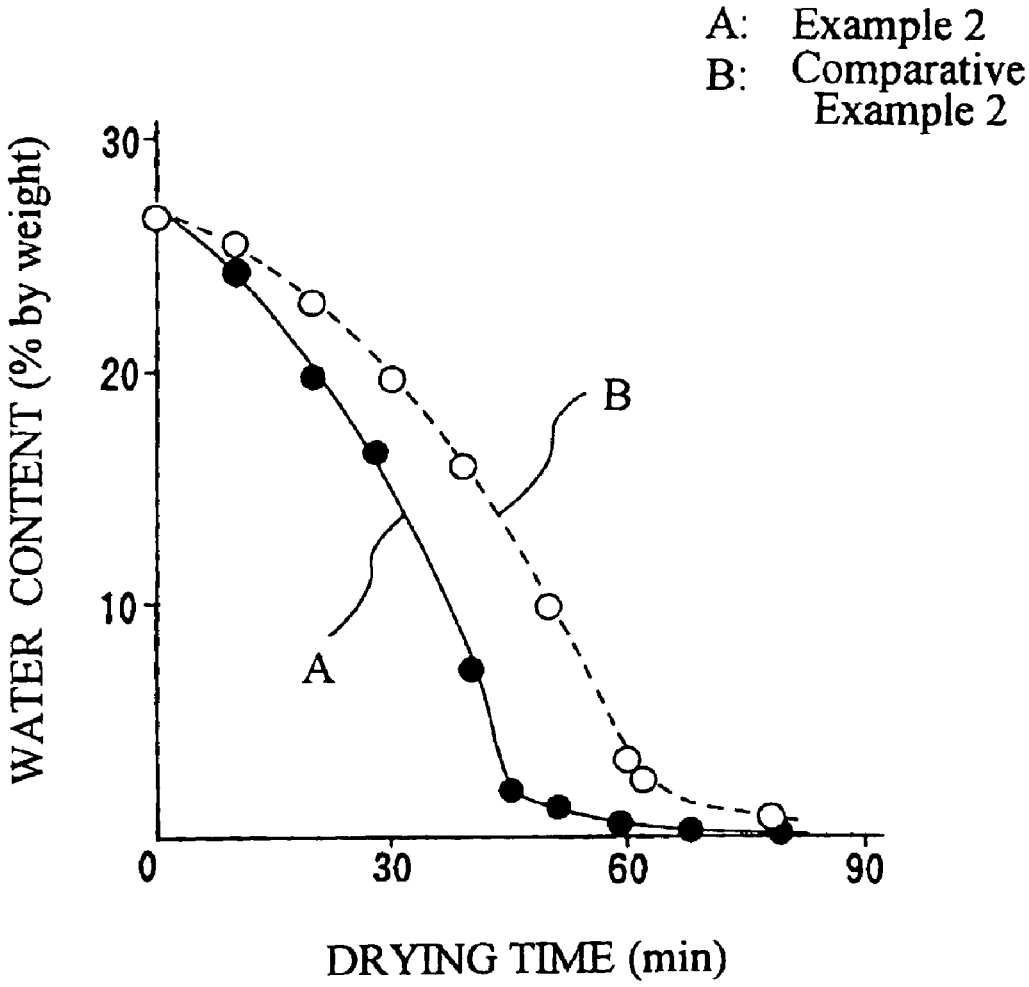
FIG. 2 is a graph showing water contents with the passage of time in Example 2 and Comparative Example 2.

As to Example 2 and Comparative Example 2, sampling of the powder was carried out, and the amount of an unreacted alcohol and the water content of the powder were determined. The results are shown in FIGS. 1 and 2, respectively.

The properties and the solution rates of the resulting anionic surfactant powders are shown in Table 1.

[Analytical Methods]

The anionic surfactant powder obtained in each of Examples and Comparative Examples was analyzed in accordance with the following methods.

(A) Concentration of Anionic Surfactant

The concentration of the anionic surfactant was determined in accordance with the method of ISO 2271.

(B) Amount of Unreacted Alcohol

An anionic surfactant powder was dissolved in a 1% by weight aqueous sodium hydroxide solution to give an anionic surfactant solution having a concentration of 20% by weight. Next, stearyl alcohol was added thereto as an internal standard, and the mixture was extracted with petroleum ether. The petroleum ether phase was analyzed to determine the amount of an unreacted alcohol by gas chromatography.

(C) Water Content

The water content was quantified by Karl Fischer's method.

(D) pH pH was determined by using an aqueous solution having a concentration of the anionic surfactant of 10% by weight, prepared by diluting the anionic surfactant powder with water.

(E) Solution Rate

A 2-L beaker was charged with 950 g of ion-exchanged water at a temperature of 30° C., and the mixture was stirred with a magnet stirrer (900 r/min). Next, 50 g of the surfactant powder was added thereto at once, and the time for reaching the constant level of electric conductivity was determined, and the time was defined as the solution rate.

TABLE 1

| | Ex. 1 | Ex. 2 | Comp. Ex. 1 | Comp. Ex. 2 |
|---|---|---|---|---|
| Drying Time (min) | 45 | 79 | 62 | 78 |
| Concentration of Anionic Surfactant (% by weight) | 96.9 | 99.0 | 96.8 | 98.3 |
| Amount of Unreacted Alcohol (% by weight) | 0.6 | 0.2 | 0.6 | 0.5 |
| Water Content (% by weight) | 2.0 | 0.2 | 2.3 | 0.8 |
| pH (10% by weight Aqueous Solution) | 10.8 | 10.8 | 10.8 | 10.8 |
| Solution Rate (sec) | 80 | — | 90 | — |

Note:
The amount of unreacted alcohol is the amount of the unreacted alcohol per concentration of the anionic surfactant.

It can be seen from the results shown in Table 1 that Example 1 requires 45 minutes for drying. To the contrary, Comparative Example 1 requires 62 minutes for drying. Therefore, it can be seen that the drying time is shortened by subjecting the powder to microwave irradiation, whereby drying can be effectively carried out.

In addition, since the pH of the powder obtained in Example 1 is 10.8, it can be seen that quality deterioration such as thermal degradation does not occur in the powder.

Further, the powder obtained in Example 1 shows higher solution rate as compared to the powder obtained in Comparative Example 1. Therefore, it can be seen that the porous powder easily dissolvable in water can be obtained by subjecting the powder to microwave irradiation.

Incidentally, if the jacket temperature is increased as in Comparative Example 1, the drying time can be shortened. However, in this case, the temperature of the mixture is increased at the portion contacted with the heat-transfer surface of the jacket, so that it is presumed that the quality deterioration such as thermal degradation tends to occur. Therefore, the process according to Example 1 is superior to the process according to Comparative Example 1.

In addition, it can be seen from the results shown in FIGS. 1 and 2 and Table 1 that when the drying time is 80 minutes, the amount of the unreacted alcohol contained in the powder of Example 2 can be reduced to 0.2% by weight, whereas the amount of the unreacted alcohol contained in the powder of Comparative Example 2 can be reduced only to 0.5% by weight. Therefore, the amount of the unreacted alcohol, which is an impurity, can be efficiently removed by subjecting the powder to microwave irradiation.

In addition, as shown in Table 1, since pH of the powder obtained in Example 2 is 10.8, it can be seen that the quality deterioration such as thermal degradation does not occur in the powder.

It can be seen from the results shown in FIGS. 1 and 2 that it is preferable that the mixture is subjected to microwave irradiation at the point where the water content reaches 16% by weight or so, because the water content is 16% by weight or so when the removal of the unreacted alcohol is started in Example 2 and Comparative Example 2. In other words, it can be seen that the microwave irradiation can quicken the drying speed, shorten the drying time, and efficiently carry out the drying for the sodium alkyl sulfate used in Example 2 when the water content not less than 16% by weight. Furthermore, when the water content is less than 16% by weight, in addition to the fact that the powder can be efficiently dried, the unreacted alcohol, which is the impurity, can be efficiently removed at the same time.

Example 3

As the anionic surfactant, there was used 200 kg of an anionic surfactant slurry, containing a sodium alkyl sulfate having 10 to 16 carbon atoms and an average molecular weight of 300 as an anionic surfactant, and having a concentration of 71.5% by weight [amount of unreacted alcohol: 1.8 parts by weight, based on 100 parts by weight of the anionic surfactant; water content in the anionic surfactant slurry: 27.7% by weight; pH (10% by weight aqueous solution): 10.9].

Next, MICROWAVE GRANULATOR DRYER commercially available from Fukae Powtec Corporation, under the trade name of FMD-1000JE having an effective volume of 800 L was charged with the anionic surfactant slurry. The pressure inside the microwave granulator-dryer was gradually decreased under the conditions of a jacket temperature of 85° C., an agitator rotational speed of 200 r/min, and a chopper rotational speed of 500 r/min. The volume expansion was visually observed from a glass window for peeping set at the top of the dryer.

The conditions employed in Example 3 and the results are listed in the following Table 2.

TABLE 2

| Procedures | Conditions: Pressure [kPa] | Jacket Temperature [° C.] | Microwave Output [kW] | Rotational Speed of AG [r/min] | Rotational Speed of CH [r/min] | Results: Time Required [h] | Water Content [% by wt] | Content of Unreacted Alcohol [% by wt] |
|---|---|---|---|---|---|---|---|---|
| Charging | 101 | | | 0 | 0 | 1.7 | 27.7 | 1.9 |
| Step 1 | 40.0 | 85 | 6 | 130 | 200 | 2.3 | 13.7 | — |
| 2 | 6.7 | 85 | 6 | 50 | 500 | 0.5 | 2.0 | — |
| 3 | 6.7 | (Not Controlled) | 6 | 130 | 2000 | 0.5 | 0.1 | 1.5 |
| 4 | 6.7 | —*1 | 3 | 130 | 2000 | 4.0 | 0.1 | 0.4 |

(Note)
The amount of unreacted alcohol is the amount of the unreacted alcohol per concentration of the anionic surfactant.
*1The temperature inside the dryer was maintained at 100° C. in step 4.

It can be seen from the above results that the volume of the slurry was expanded to the top of the dryer when the pressure reached 300 Torr (40 kPa). The drying of the slurry was continued by subjecting the slurry to microwave irradiation at this pressure under the conditions of a microwave frequency of 2450 MHz and an output of 2 kW.

As a result, the time period required for drying was 9 hours, and the production rate was 16 kg/h, and the final amount of the unreacted alcohol was 0.4% by weight.

Example 4

The same procedures as in Example 3 were carried out except that 203 kg of the anionic surfactant slurry was previously continuously introduced into DEFOAMER DEAERATOR commercially available from EBARA CORPORATION (continuous vacuum deaeration device "Ebaradeaemild UCD2"), in which a screen plate was removed, warm water of 50° C. was circulated in ajacket, and the pressure was controlled to 100 Torr (13 kPa)] at a flow rate of 118 kg/h, and discharged from the DEFOAMER DEAERATOR before the anionic surfactant slurry was introduced into the MICROWAVE GRANULATOR DRYER commercially available from Fukae Powtec Corporation, under the trade name of FMD-1000JE.

The conditions employed in Example 4 and the results are listed in the following Table 3.

TABLE 3

| Procedures | Conditions: Pressure [kPa] | Jacket Temperature [° C.] | Microwave Output [kW] | Rotational Speed of AG [r/min] | Rotational Speed of CH [r/min] | Results: Time Required [h] | Water Content [% by wt] | Content of Unreacted Alcohol [% by wt] |
|---|---|---|---|---|---|---|---|---|
| Charging | 13.3 | 85 | 0 | 50 | 0 | 1.7 | 27.7 | 1.8 |
| Step 1 | 13.3 | 85 | 6 | 130 | 200 | 0.3 | 15.7 | — |
| 2 | 6.7 | 85 | 6 | 50 | 500 | 0.8 | 2.9 | — |
| 3 | 6.7 | (Not Controlled) | 6 | 130 | 2000 | 0.4 | 0.2 | 1.5 |
| 4 | 6.7 | —*1 | 3 | 130 | 2000 | 4.0 | 0.1 | 0.5 |

(Note)
The amount of unreacted alcohol is the amount of the unreacted alcohol per concentration of the anionic surfactant.
*1The temperature inside the dryer was maintained at 100° C. in step 4.

As a result, the time period required for drying was 7.2 hours, and the production rate was 20 kg/h, and the final amount of the unreacted alcohol was 0.5% by weight. The quality of the anionic surfactant obtained in Example 4 was the same level as that obtained in Example 3.

According to Example 4, the anionic surfactant can be prepared in a high productivity in a shorter period of time, as compared with Example 3.

According to the process of the present invention, there can be obtained an anionic surfactant powder having a small content of impurities (for instance, an unreacted alcohol in a case of the alkyl sulfate; 1,4-dioxane produced as a by-product in a case of the polyoxyethylene alkyl ether sulfate), with small energy load and efficiently drying a solvent mixture containing an anionic surfactant in a short time without causing quality deteriorations.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for preparing anionic surfactant powder comprising subjecting a mixture of an anionic surfactant and not more than 40% by weight of a solvent to microwave irradiation under a reduced pressure of 4 to 55 kPa to remove at least a part of the solvent from the mixture.

2. The process of claim 1, wherein the reduced pressure is 6 to 30 kpa.

3. A process for preparing anionic surfactant powder comprising defoaming a mixture of an anionic surfactant and not more than 40% by weight of a solvent with a deaerator defoaming device, and subjecting the mixture to microwave irradiation to remove at least a part of the solvent from the mixture.

4. The product of the process of claim 1, being an anionic surfactant powder having a solvent content of not more than 5% by weight.

5. The product of the process of claim 2, being an anionic surfactant powder having a solvent content of not more than 5% by weight.

6. The product of the process of claim 3, being an anionic surfactant powder having a solvent content of not more than 5% by weight.

* * * * *